United States Patent [19]

Venegoni

[11] Patent Number: 4,911,295

[45] Date of Patent: Mar. 27, 1990

[54] BUCKET ORGANIZER TRAY

[76] Inventor: Daniel E. Venegoni, 9011 Marcella, St. Louis, Mo. 63121

[21] Appl. No.: 270,846

[22] Filed: Nov. 14, 1988

[51] Int. Cl.[4] ..... B65D 21/00

[52] U.S. Cl. ..... 206/372; 206/509; 220/94 A; 220/23.83

[58] Field of Search ..... 206/503, 372, 510, 509; 220/23.83, 94 A, 23.86

[56] References Cited

U.S. PATENT DOCUMENTS

| | | | |
|---|---|---|---|
| 304,805 | 8/1884 | Doutteil | 220/23.83 |
| 1,395,301 | 11/1921 | Sechrist | 206/503 |
| 1,502,073 | 7/1924 | Wagner | 220/23.83 |
| 1,641,283 | 9/1927 | MacDougall | 206/499 X |
| 1,810,080 | 6/1931 | Kegel | 206/499 X |
| 2,960,250 | 11/1960 | Haloski | 206/503 |
| 3,093,238 | 6/1963 | King | 206/4 |
| 3,186,575 | 6/1965 | Gravos et al. | 220/20 |
| 3,220,541 | 11/1965 | Wei | 206/503 |
| 3,243,038 | 3/1966 | Caramanian | 206/47 |
| 3,266,623 | 8/1966 | Poferl | 206/4 |
| 3,369,691 | 2/1968 | Wei | 206/503 |
| 3,398,827 | 8/1968 | Laskin | 220/23.83 |
| 3,608,945 | 9/1971 | Heltz | 294/27 |
| 3,777,882 | 12/1973 | McIntyre | 206/16 |
| 3,856,178 | 12/1974 | Norgaard | 220/23.83 |
| 4,119,231 | 10/1978 | Johnson | 215/6 |
| 4,720,021 | 1/1988 | Byrns | 206/373 |

*Primary Examiner*—Joseph Man-Fu Moy
*Attorney, Agent, or Firm*—Grace J. Fishel

[57] ABSTRACT

A sectioned tote for parts, tools and the like is formed from a bucket and a plurality of organizer trays. The trays are identical to each other in the provision of a circular bottom wall joined to an annular peripheral upstanding sidewall. The trays are also identical in that a handle is recessed in the face of the tray and the annular peripheral upstanding sidewall is of an external diameter which is a close but nevertheless free fit within the bucket. Fixed and/or removable partitions are provided in the bottom of the tray for sorting the various parts, tools and the like.

4 Claims, 1 Drawing Sheet

BUCKET ORGANIZER TRAY

BACKGROUND OF THE INVENTION

1. Field of the Invention

The present invention relates to an organizer tray for parts, tools and the like, individual ones of which are adapted to stack in an ordinary bucket.

2. Description of the Prior Art

Workers at construction sites typically make use of empty paint buckets or the like as inexpensive containers for transporting parts and tools. Plumbers use them for copper fittings, mainly ½, ¾ and 1-inch sizes. Electricians use them for junction boxes, switches, wire nuts and so forth and finish carpenters use them for screws, bolts, nuts, washers, hardware for locks and the like. In use, common to all trades, the contents of the bucket are dumped out on the floor to find the particular part or tool wanted. This operation can damage fragile parts or tools, contributes to the disarray and requires the user to pick up the remaining items and put them back in the bucket.

In view of the above, there is a need for an organizer tray, preferably inexpensive to fabricate, multiple ones of which are adapted to fit in an ordinary bucket and sturdy enough to support parts or tools. It is therefore an object of the present invention to provide such a bucket organizer tray. Other objects and features of the invention will be in part apparent and in part pointed out hereinafter.

The invention accordingly comprises the constructions hereinafter described and their equivalents, the scope of the invention being indicated in the subjoined claims.

SUMMARY OF THE INVENTION

In accordance with the present invention, each bucket organizer tray is identical to the other in the provision of a circular bottom wall joined to an annular peripheral upstanding walls. The diameter of the annular peripheral upstanding sidewall is varied such that the lower end of the annular peripheral upstanding sidewall fits snugly within the annular peripheral upstanding sidewall of a similar tray upon which it can be stacked. This is accomplished by increasing the inside diameter of the annular peripheral upstanding sidewall distal the bottom wall or, as shown in the drawings, by reducing its outside diameter proximate the bottom wall. The trays are also identical to each other in that a handle is recessed in the face of the tray and the annular peripheral upstanding sidewall is of an external diameter which is a close but nevertheless free fit within a bucket. The nested nature of the trays keeps them from shifting laterally relative to one another in the bucket and is advantageous for stacking them for storage and other purposes independently of the bucket. Fixed or removable partitions or some combination thereof can be provided in the bottom of the tray such that a tray can hold several different kinds of parts or tools without commingling them.

BRIEF DESCRIPTION OF THE DRAWINGS

In the accompanying drawings, in which one of various possible embodiments of the invention is illustrated, corresponding reference characters refer to corresponding parts throughout the several views of the drawings and in which.

DETAILED DESCRIPTION OF THE INVENTION

Figure 1:
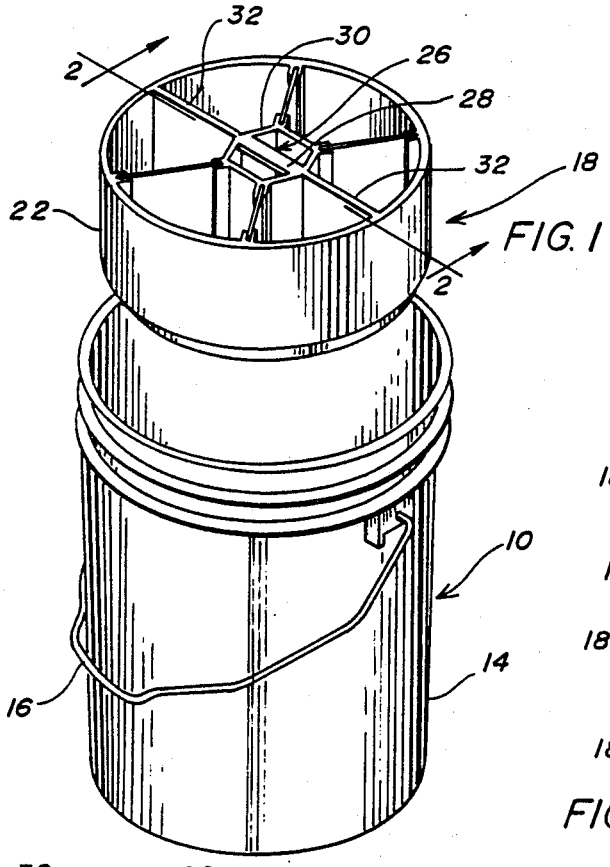
FIG. 1 is a perspective view of an organizer tray being placed in a bucket.
Figure 2:
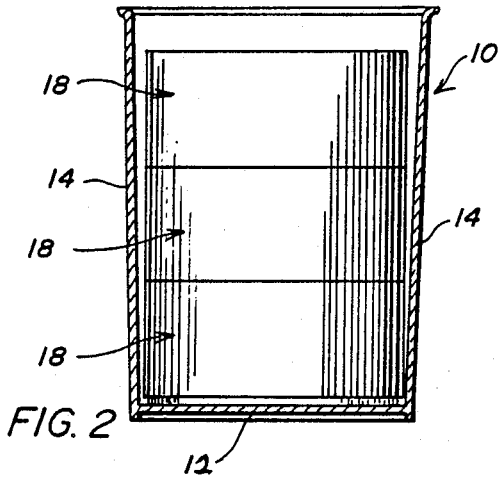
FIG. 2 is a sectional view taken along line 2—2 in FIG. 1 showing a stack of three organizer trays in the bucket.

Referring to the drawings more particularly by reference character, reference number 10 refers to a bucket having a circular bottom wall 12 joined to an upstanding generally cylindrical sidewall 14 which typically is in the shape of a right circular cylinder or is flared upwardly and outwardly in a frustum of a right cone. A carrying handle or bail 16 is pivotally connected to the outside of bucket 10 near the open end of sidewall 14.

Conventionally bucket 10 is made of plastic but it may also be formed of other materials such as sheet metal or cardboard. With particular reference to FIG. 1, bucket 10 is shown as a conventional container such as ordinarily used for paint cans, mastic or the like. Such a can is inexpensive to use as tote because it is left over at construction sites but at the same time is rugged in use. A bucket of the construction described having a capacity of 5 gallons typically has an internal diameter of about 10¼ inches at its bottom and 11 inches at its top with a height of 14 inches. These dimensions are not critical and are given merely as representative of one practical embodiment of the described structure.

With continuing reference to the drawings, an organizer tray 18 in accordance with the present invention is formed of the same materials as bucket 10 and has a circular bottom wall 20 and an annular peripheral upstanding sidewall 22. The outside diameter of the annular peripheral upstanding sidewall is varied such that the lower end of the annular peripheral upstanding sidewall fits snugly within the annual peripheral upstanding sidewall of a similar tray upon which it can be stacked. To maximize the storage capacity of tray 18, it is preferred that the outside diameter of annular peripheral upstanding sidewall 22 be reduced near its attachment to bottom wall 20 forming an annular abutment shoulder 24 such that the lower end of annular peripheral upstanding sidewall 22 fits snugly within and rests upon the annular peripheral upstanding sidewall 22 of a similar tray.

Figure 3:
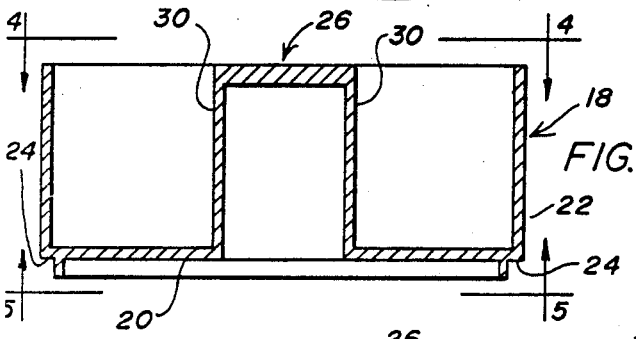
FIG. 3 is a sectional view taken along line 3—3 in FIG. 4.
Figure 4:
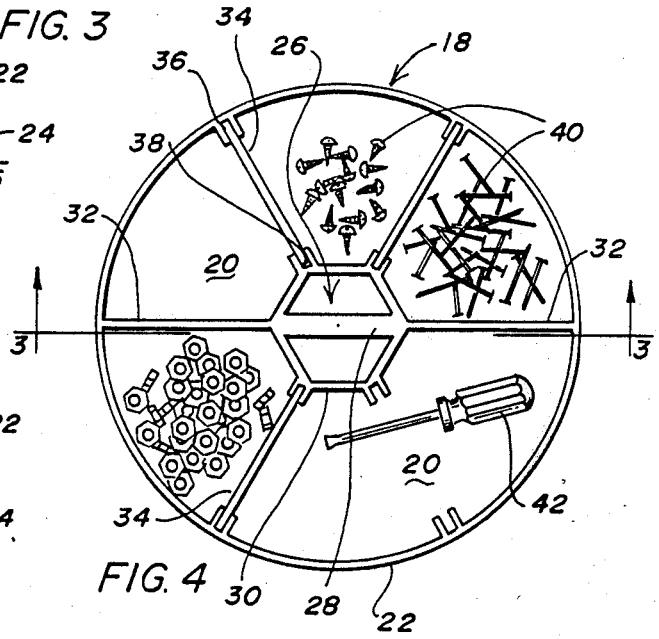
FIG. 4 is a top view of the organizer tray taken along line 4—4 in FIG. 3; and, FIG. 5 is a bottom view of the organizer tray taken along line 5—5 in FIG. 3.
Figure 5:
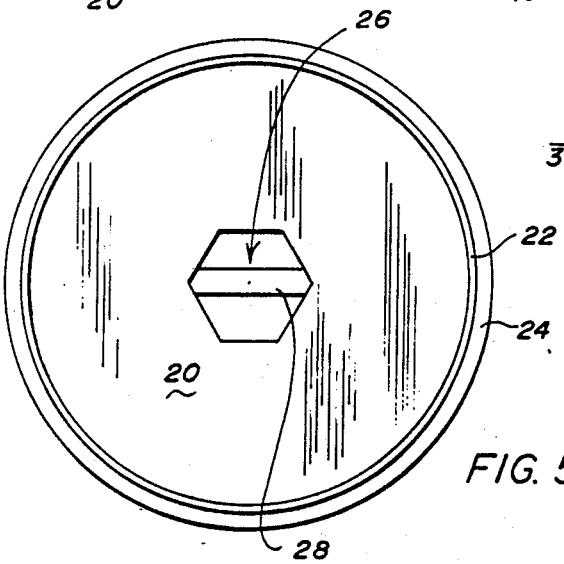

A handle 26 is attached to the bottom of organizer tray 18 and is preferably recessed in the face of the tray such that it does not protrude above sidewalls 22. As shown in FIGS. 3–5, handle 26 can take the form of a strap 28 attached to a hollow stem 30 opening through and centrally attached to bottom wall 20.

Annular peripheral upstanding sidewall 22 is of an external diameter which is a close but nevertheless free fit within bucket 10. When bucket 10 has an internal diameter of 10¼ inches at its bottom and 11 inches at its top, the outside diameter of annular peripheral upstanding sidewall 22 is preferably about 10 inches. This dimension, however, is not critical as it will depend on the dimensions of the bucket. For maximum benefit in organization, it is preferred that the relative height of sidewall 22 of the tray to the height of sidewall 14 of the bucket be selected such that multiple trays can be stacked in the bucket. When sidewall 14 of the bucket is 14 inches, sidewall 22 of the tray is advantageously about 4 inches. This dimensions, as before, is not critical and can be varied to suit the use to be made of the tray.

As best seen in FIG. 4, a pair of radial walls 32 are provided across the diameter of bottom wall 20 joining upstanding sidewall 22 to stem 30. Walls 32 may be removable but are illustrated as fixed partitioning tray 18 in half and serving as a reinforcing web to stiffen the tray and to prevent buckling of it when it is loaded with heavy parts and tools. Additional radial walls 34 shown as removable are received in slots 36 and 38 attached to sidewall 22 and stem 30, respectively, for further subdividing the tray.

In use, a sectioned tote for parts 40, tools 42 and the like is provided from a new or used bucket within which are stacked a plurality of organizer trays 18. Prior to insertion into bucket 10, parts 40, tools 42 and the like are sorted onto trays 18 into compartments formed between radial walls 32 and 34. When a particular part or tool is needed, trays 18 are serially lifted from bucket 10 by strap 28 until the relevant tray is accessed. This tray is then removed from the bucket by its strap 29 or the part or tool simply picked from the tray without removing its from the bucket. As the trays are removed from the bucket, they may be stacked in reverse order on each other for use apart from the bucket. Upon completion of the part or tool removal operation, trays 18 can be restacked in the bucket thus readying the tote for transport to another location.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A sectioned tote for parts, tools and the like comprising a materials bucket with a bail and with a plurality of nesting organizer trays, each of which has a face with a circular bottom wall joined to an annular peripheral upstanding sidewall, said annular peripheral upstanding sidewall having a diameter which is varied such that the lower end of the annular peripheral upstanding sidewall fits snugly within the annular peripheral upstanding sidewall of a similar tray adjacent the open top thereof and upon which it can be stacked, and including a stationary handle recessed into the face of the tray said annual peripheral upstanding sidewall having an outside diameter for close but free fit within the bucket and a height such that multiple trays can be stacked upon each other within the bucket.

2. The sectioned tote of claim 1 wherein the handle is attached to a stem centrally attached to the bottom wall and wherein a plurality of radial walls join the annular peripheral upstanding sidewall and the stem subdividing the tray.

3. The sectioned tote of claim 2 wherein a pair of radial walls are fixedly attached across the diameter of the bottom wall to the annular peripheral upstanding sidewall and the stem forming a stiffening web.

4. The sectioned tote of claim 3 wherein removable radial walls are additionally provided.

* * * * *